US009862081B2

(12) United States Patent
McAvey

(10) Patent No.: US 9,862,081 B2
(45) Date of Patent: Jan. 9, 2018

(54) CHECK VALVE REBUILD TOOL

(71) Applicant: McAvey Enterprises LLC, Ridgewood, NJ (US)

(72) Inventor: Michael McAvey, Ridgewoood, NJ (US)

(73) Assignee: MCAVEY VENTURES LLC, Ridgewood, NJ (US)

( * ) Notice: Subject to any disclaimer, the term of this patent is extended or adjusted under 35 U.S.C. 154(b) by 493 days.

(21) Appl. No.: 14/211,628

(22) Filed: Mar. 14, 2014

(65) Prior Publication Data

US 2014/0259436 A1 Sep. 18, 2014

Related U.S. Application Data

(60) Provisional application No. 61/789,543, filed on Mar. 15, 2013.

(51) Int. Cl.
*B25B 27/00* (2006.01)

(52) U.S. Cl.
CPC ..... *B25B 27/0035* (2013.01); *B25B 27/0028* (2013.01); *Y10T 29/4973* (2015.01); *Y10T 29/49815* (2015.01)

(58) Field of Classification Search
CPC ... B25B 27/0035; B25B 27/0028; B25F 1/02; Y10T 29/4973; Y10T 29/49815
USPC ..... 7/100; 81/3.48, 3.49, 488
See application file for complete search history.

(56) References Cited

U.S. PATENT DOCUMENTS 1,542,503 A * 6/1925 Haidle ..... A22B 7/002 294/26
3,145,463 A * 8/1964 Hockett ..... B25B 27/0028 29/229
4,141,129 A * 2/1979 Martini ..... B23P 19/084 29/235
4,610,834 A * 9/1986 Baron ..... B25B 27/0028 264/249
4,813,120 A * 3/1989 Fournier ..... B25B 27/0028 29/235
5,138,752 A * 8/1992 Tasner ..... B25B 27/0028 29/235
6,108,884 A * 8/2000 Castleman ..... B23P 19/084 29/235

* cited by examiner

*Primary Examiner* — Larry E Waggle, Jr.
*Assistant Examiner* — Danny Hong
(74) *Attorney, Agent, or Firm* — Brinks Gilson & Lione

(57) ABSTRACT

A rebuild tool for a motorcycle fuel tank quick connect fuel tank fitting has a mandrel tool with at least one post extending from a body portion. The post has an internal bore and an axial groove. A generally cylindrical bushing has an internal bore enabling the bushing to be disposed on the at least one post. The bushing forms an axial slit. At least one O-ring capture hook may be installed onto the mandrel tool within the axial groove and locked into place by rotating the bushing on the post. The assembled mandrel tool including the bushing and the O-ring hook is dimensioned to be inserted into the fuel tank fitting for removing at least one of the O-rings. A sleeve element has a bore enabling the sleeve element to be disposed on the post, and a stem element has an enlarged head and a reduced diameter stem section.

3 Claims, 5 Drawing Sheets

CHECK VALVE REBUILD TOOL

CROSS-REFERENCE TO RELATED APPLICATIONS

This application claims the priority of Provisional Application No. 61/789,543, filed on Mar. 15, 2013, which is herewith incorporated by reference in its entirety.

FIELD OF THE INVENTION

This invention relates to a maintenance tool and in particular to a tool for rebuilding check valves/fuel fitting of certain motorcycle tank fuel line connections.

BACKGROUND OF THE INVENTION

There are numerous maintenance and repair procedures required for motorcycles. One maintenance procedure that has been difficult to carry out in a shop setting is the repair of a certain fuel system fitting found in Harley-Davidson heavyweight motorcycles, which exist in large numbers in the United States and throughout the world. Such motorcycles feature the fuel tank having an internal fuel sending unit with an electric fuel pump. The sending unit is connected with a female fitting at the bottom of the tank to which a fuel line fitting is attached, which in turn supplies fuel to the engine fuel injection system. The female fitting has a quick release sleeve enabling these parts to be easily assembled and disassembled. The tank female fitting includes internal check valve elements, which are intended to prevent leakage of fuel when the fuel line is disconnected from the fitting. The valve is a seat valve with a valve member which is lifted off a valve seat when the male fuel line fitting is attached.

The tank female quick connect fitting described above has two internal O-rings which provide sealing when the connection is made, an upper O-ring and a lower O-ring. The lower O-ring (a larger diameter one) seals around the outside diameter of the fuel line male fitting. A smaller diameter upper O-ring acts as the valve seat for the valve member to stop fuel flow when the fuel line is disconnected. Due to the deterioration and wear it is sometimes necessary to service the fitting O-ring and internal valve elements. This is particularly true with alcohol gasoline blended fuels which tend to deteriorate these parts. Heretofore there have been few tools available for such servicing, and it is generally necessary to remove the fuel tank from the vehicle for such service, which is a time intensive process. Requiring the tank to be removed is an extra step, which takes additional shop service time. It is therefore desirable to provide a fitting rebuild tool which enables the previously mentioned tank fuel fitting to be serviced quickly, easily, and without requiring removal of the fuel tank.

SUMMARY OF THE INVENTION

The fuel fitting rebuild tool for a motorcycle fuel tank quick connect fuel tank fitting in accordance with the present invention enables fast servicing of the tank fitting. The fitting can be rebuilt without requiring removal of the fuel tank from the motorcycle.

According to a first aspect of the invention, the rebuild tool has a mandrel tool with at least one post extending from a body portion. The post has an internal bore and an axial groove. A generally cylindrical bushing has an internal bore enabling the bushing to be disposed on the at least one post.

The bushing forms an axial slit. At least one O-ring capture hook may be installed onto the mandrel tool within the axial groove and locked into place by rotating the bushing on the post. The assembled mandrel tool including the bushing and the O-ring hook is dimensioned to be inserted into the fuel tank fitting for removing at least one of the O-rings. The rebuild tool may further include a sleeve element with a bore enabling the sleeve element to be disposed on the post, and a stem element with an enlarged head and a reduced diameter stem section.

The mandrel tool may be a two-piece mandrel tool with a first mandrel portion carrying a first post and a second mandrel portion carrying a second post, the first and second posts having different lengths.

According to another aspect of the invention, a method of rebuilding a quick connect fitting may include any or all of the following steps:

A tool may be provided that has a mandrel with at least one post extending from a body portion, the post forming an internal bore and an axial groove, a generally cylindrical bushing having an internal bore enabling the bushing to be disposed on the post, the bushing forming an axial slit, a mandrel element having a bore enabling the mandrel to be disposed on the post, a stem element, and at least one O-ring capture hook which may be installed onto the mandrel element within the mandrel element slit and locked into place by rotating bushing on the post, the assembled mandrel, bushing and the O-ring hook adapted to be inserted into the fuel tank fitting for removing at least one of the O-rings.

The bushing may be positioned over the post and the bushing slit aligned with the post groove. The hook is then inserted in the post groove through the bushing slit. The bushing is then rotated relative to the post to lock the hook in position.

The tool can then be inserted into the fitting and rotated, causing the hook to capture at least one of the O-rings. The tool is then removed from the fitting, thereby removing one on the O-rings.

For removing the second O-ring, the first hook is removed and the bushing is positioned over the same or a different post. The bushing slit and the post groove are aligned again, and the second hook is inserted into the post groove. The bushing is then rotated relative to the post to lock the hook in position.

The tool can then be inserted into the fitting and rotating the tool causing the second hook to capture the second O-ring. With the second O-ring, the valve stem, and the spring from the valve are likewise removed.

For replacing the parts, the sleeve is positioned on the mandrel post, and the valve stem, the spring, and the upper O-ring are placed on the sleeve, The tool may then be inserted into the fitting, thereby installing the spring, the valve stem, and the upper O-ring.

The tool is removed, and the pilot stem may be inserted into the fitting. The lower O-ring may then be placed around the stem.

The sleeve may then be placed on the mandrel post, and the tool is pushed into the valve fitting, thereby positioning the lower O-ring. Finally, the tool may be removed from the fitting.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1A:
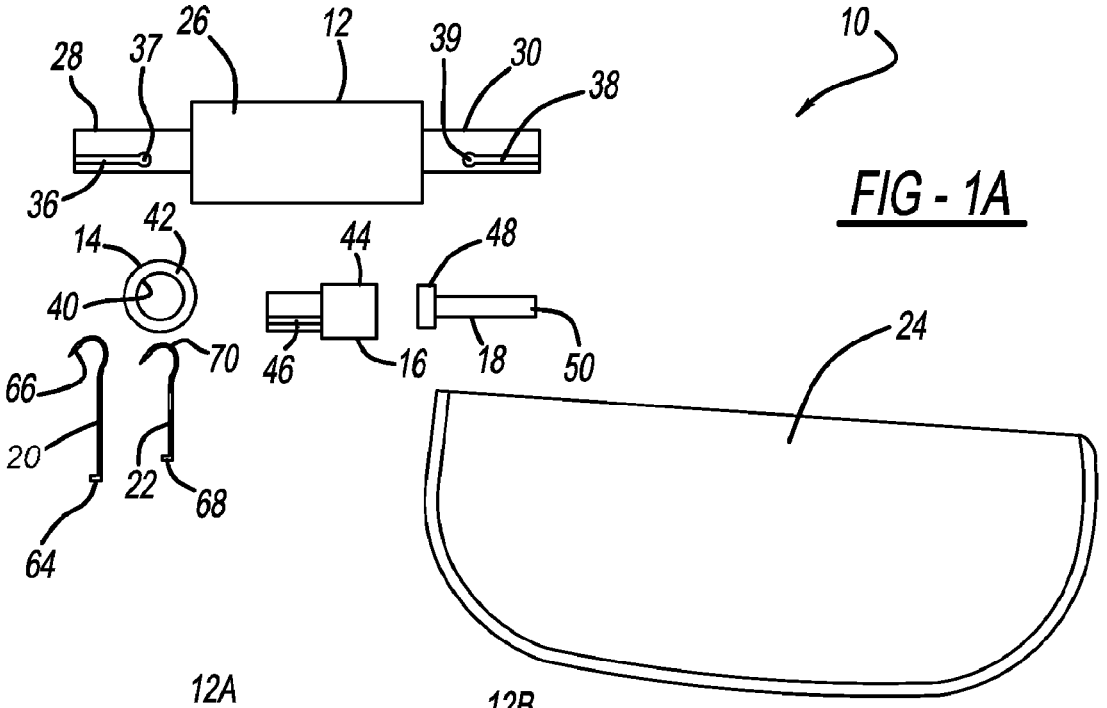
FIG. 1A shows the major components of a rebuild tool in accordance with this invention, including a one-piece mandrel tool.

The drawing figures are included for purely illustrative purposes and are not intended to limit the scope of the invention.

With particular reference to FIG. 1*a*, the main components of a fitting rebuild tool 10 are illustrated. Rebuild tool 10 principally comprises mandrel element 12, bushing 14, sleeve 16, pilot stem 18, and a pair of O-ring capture hooks 20 and 22. The entire assembly fits within storage bag 24.

Mandrel element 12 features main cylindrically shaped body portion 26, with a pair of coaxial cylindrical posts 28 and 30 extending from opposite axial ends. Post 28 and 30 have similar outside diameters and each feature inside bores 32 and 34. In one embodiment of the present invention, post 30 is longer than post 28. Post 28 features an axial groove 36, terminating in a radial bore 37. Post 30 features an axial groove 38, terminating in a radial bore 39. The length of post 28 is dimensioned to enter the fitting 54 to a depth suited for removing a lower O-ring 52, post 30 is dimensioned to enter the fitting 54 to a depth suited for removing an upper O-ring 58, as will be described in more detail below.

Bushing 14 forms an internal bore 40 and has an axial slit 42 forming an axially extending gap in the cylindrical wall. Bushing 14 is dimensioned to fit over posts 28 and 30.

Sleeve 16 forms two diameter sections 44 and 46, and has an internal bore enabling the sleeve to be placed over post 30. Wider diameter section 44 is wider than the internal diameter of fitting 54 (shown in FIG. 3), while narrower diameter section 46 fits inside the internal diameter of fitting 54.

Pilot stem 18 forms a cylindrical base 48 and a protruding reduced diameter stem section 50. Cylindrical base 48 fits inside the internal diameter of fitting 54, and reduced diameter stem section 50 fits inside bores 32 and 34.

Hook 20 is provided for capturing the upper O-ring 58, and hook 22 captures the lower O-ring 52. Hooks 20 and 22 each form an inward bent end 64 and 68, respectively, and barbed capture ends 66 and 70 respectively. The bent ends 64 and 68 are bent at an angle of approximately 90° from a straight portion for insertion into radial bores 37 and 39, respectively, while the adjacent straight portion of hooks 20 and 22 extends in an axial direction in the groove 36 and 38, respectively. The capture ends 66 and 70 form a clockwise curl when viewed from the side of the bent ends. Alternatively, the capture ends may be curled in the opposite, counterclockwise direction. In that event, all turning movements described below should also be performed in the counterclockwise direction and not in the clockwise direction.

Figure 1B:
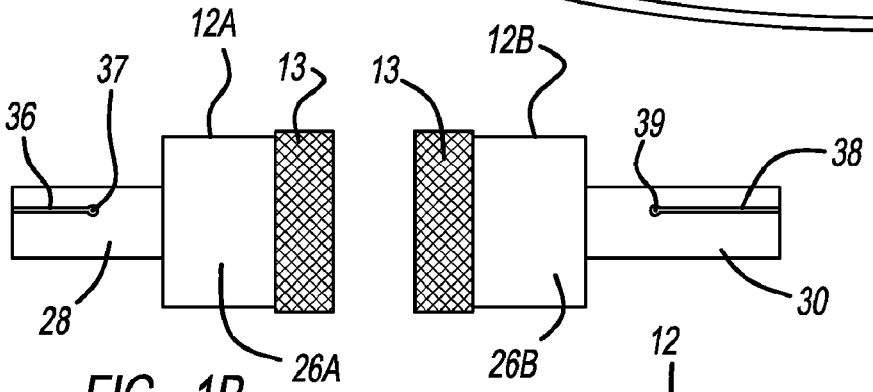
FIG. 1B shows an alternative two-piece mandrel suited for replacing the one-piece mandrel of FIG. 1A.

In FIG. 1B, the mandrel element is separated into two separate pieces consisting of a first mandrel portion 12A and a second mandrel portion 12B. Mandrel portion 12A features a main cylindrically shaped body portion 26A, with cylindrical post 28 extending from one axial end of the body portion 26A. The body portion 26A further carries a textured grip surface 13 on its circumference for easier handling. Mandrel portion 12B features a main cylindrically shaped body portion 26B, with cylindrical post 30 extending from one axial end of the body portion 26B. The body portion 26B further carries a textured grip surface 13 on its circumference for easier handling. Posts 28 and 30 are identical to posts 28 and 30 of FIG. 1A so that the one-piece mandrel element of FIG. 1A and the two-piece mandrel element of FIG. 1B are interchangeable.

While the further drawings illustrate the use of the one-piece mandrel element 12 of FIG. 1A, the same steps can be performed with the separate mandrel portions 12A and 12B of FIG. 1B.

Figure 2:
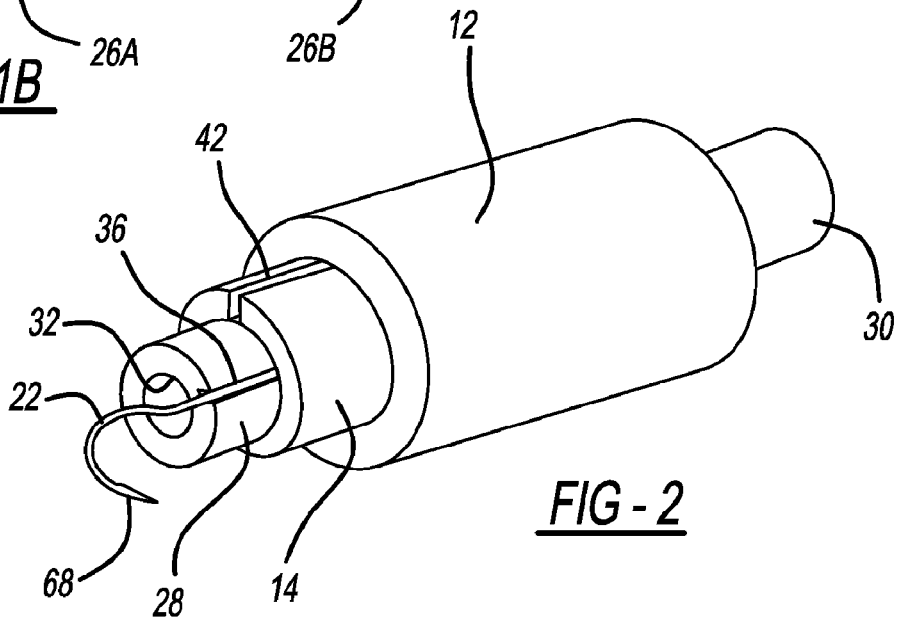
FIG. 2 is a pictorial view of the rebuild tool shown with an installed hook for removing the tank fitting lower O-ring.

Now with reference to FIG. 2 an initial step of using tool 10 is shown. In this condition, the tool 10 is adapted for removing lower O-ring 52 (shown in FIGS. 3 and 4). In this condition, bushing 14 is inserted over post 28. Groove 36 and slit 42 are aligned allowing hook 22 to be positioned as shown in FIG. 2. The radial bore 37 in post 28 communicates with groove 36 and receives the short bent end 68 of hook 22 to position the hook capture end 70 as desired. Once installed, hook 22 is locked into position by rotating bushing 14 to bring slit 42 out of alignment with groove 36.

Figure 3:
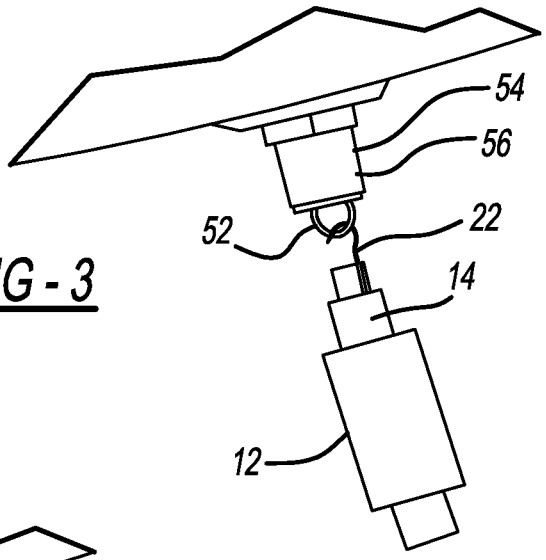
FIG. 3 shows a tool been inserted into the tank fitting.
Figure 4:
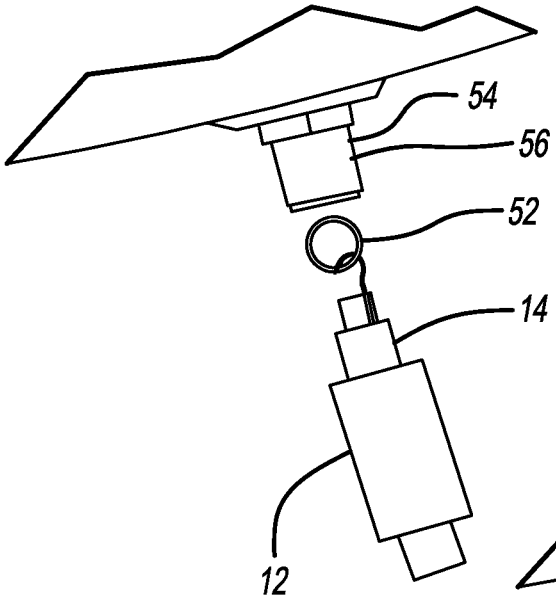
FIG. 4 shows the lower O-ring being withdrawn from the tank fitting.

FIG. 3 shows tool 10 in an initial stage of repairing fuel tank fitting 54. Fitting 54 is a standard component found in Harley-Davidson brand heavyweight motorcycles and has internal components (which will be described below) for preventing fuel leakage when the associated male connection of the fuel system fuel line (not shown) is attached. In the operational step shown in FIG. 3, release sleeve 56 of fitting 54 is pushed to its upper position and tool 10 is inserted into the fitting. Piloting provided by stem 28 and bushing 14 accurately positions hook 22, such that it interacts with lower O-ring 52. Once tool 10 is inserted into fitting 54, it is rotated clockwise, which causes hook 22 to capture lower O-ring 52. Thereafter, tool 10 is pulled downward, withdrawing and removing lower O-ring 52 as illustrated in FIG. 4. This completes the initial step in the process of rebuilding fitting 54.

Figure 5:
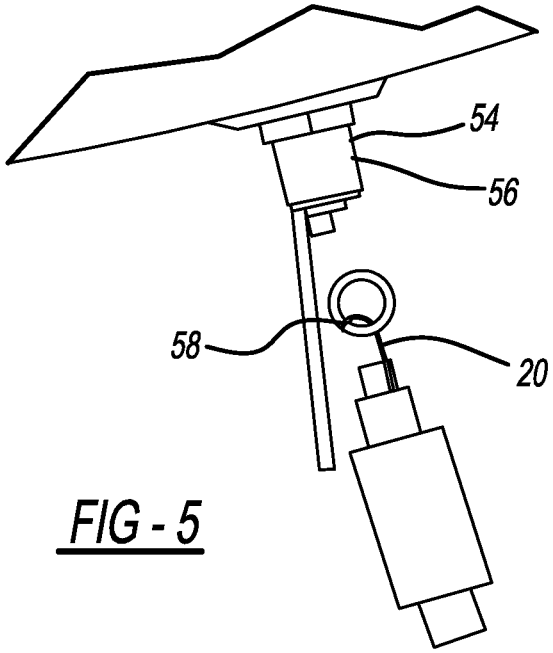
FIG. 5 shows the internal valve, the upper O-ring, and the seat valve elements being removed from the tank fitting.

The next step in servicing fitting 54 is shown with reference to FIG. 5. For this operation, bushing 14 is positioned over post 30. Groove 38 and slit 42 are aligned to permit hook 20 to be inserted and is locked into position by rotating bushing 14, in the same manner as when using hook 22. The internal radial bore 39 engages with hook end 64 to properly position hook capture and 64. This assembly is depressed upward into fitting 54 and rotated clockwise, which causes hook 20 to capture upper O-ring 58, enabling it to be removed as illustrated. When upper O-ring 58 is removed, other internal components within fitting 54 are free to fall out. These components include valve stem 60 and spring 62. Following this step, the internal components of fuel tank fitting 54 are removed, and new O-ring parts, and perhaps valve stem 60 and spring 62 may be replaced.

Figure 6:
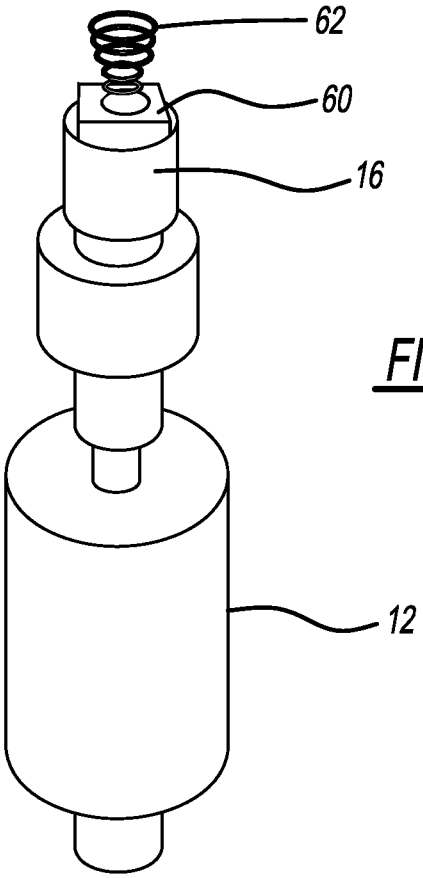
FIG. 6 shows the tool with the valve elements and upper O-ring installed on the tool.
Figure 7:
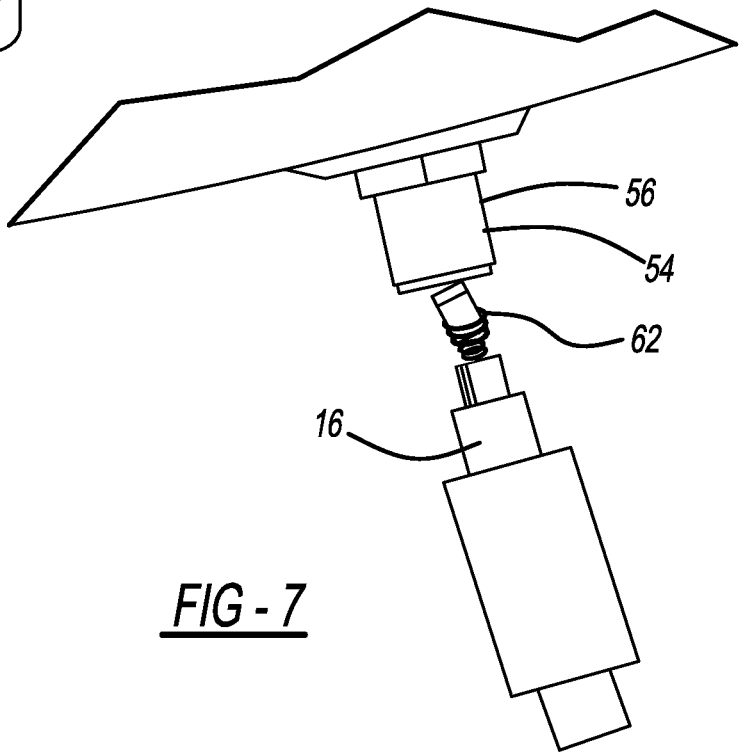
FIG. 7 shows the upper O-ring being installed along with the valve elements.

Now referring to FIG. 6, a step in the process of reassembling components of fitting 54 is shown. Sleeve 16 is installed over post 30 and provides an internal bore diameter which receives and closely conforms to upper O-ring 58, and also receives valve stem 60 and spring 62. This assembly is inserted into the tank fitting 54 while pushing its release sleeve upward, and inserting the assembly which positions the parts accurately within the fitting where they tend to remain as the tool 10 is removed from the fitting, leaving the installed upper O-ring 58, stem 60, and spring 62.

Figure 8:
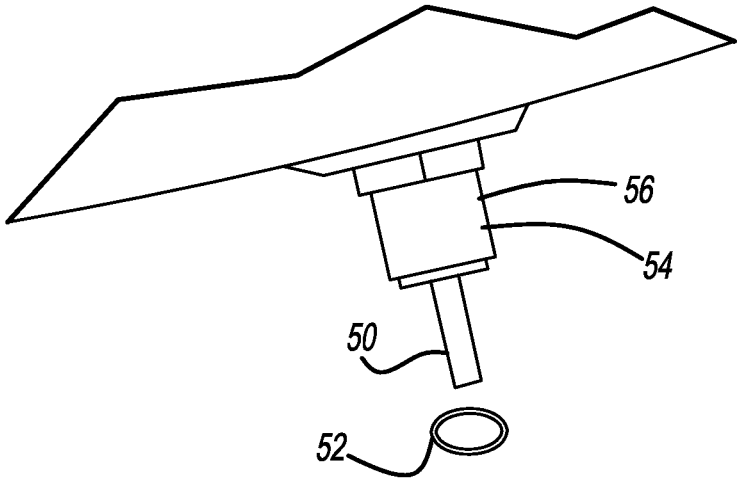
FIG. 8 shows the lower O-ring installed onto the tool.
Figure 9:
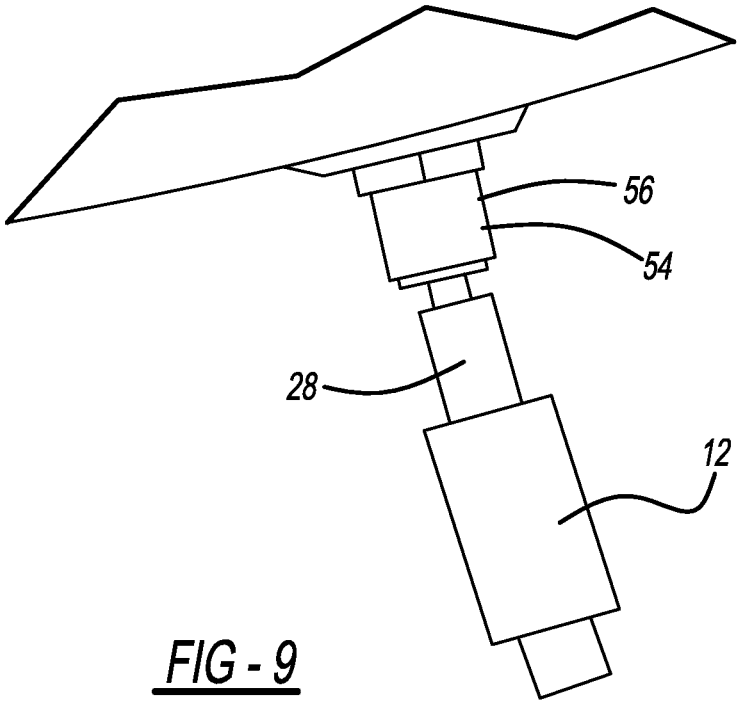
FIG. 9 shows the lower O-ring been installed into the tank fitting.
Figure 10:
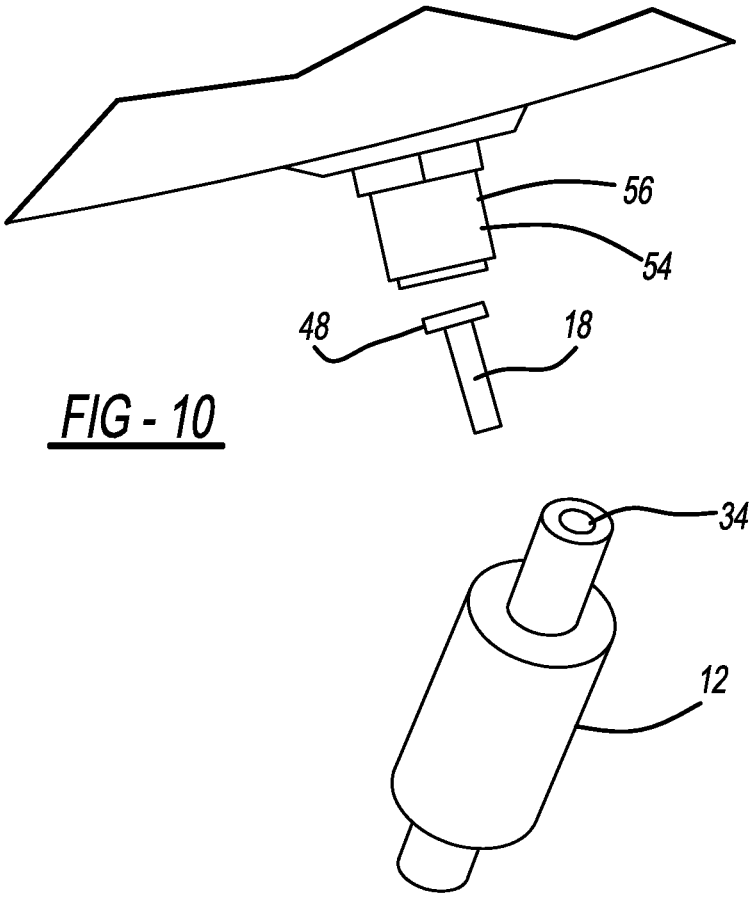
FIG. 10 shows the piloting element being removed.
Figure 11:
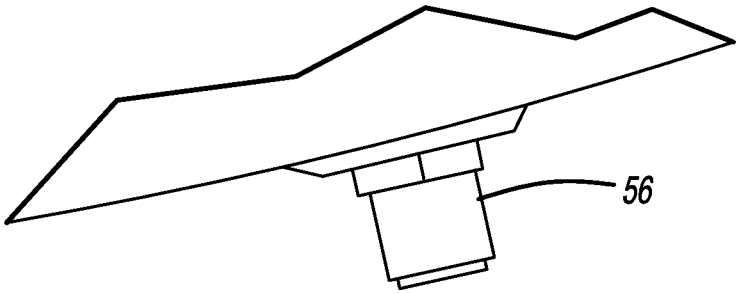
FIG. 11 shows the tank fitting after the completion of the rebuilding service.

Next, pilot stem 18 is installed inside fitting 54 as shown in FIG. 8 and lower O-ring 52 is pushed into the fitting. Next, mandrel 12 is pushed upward with pilot stem 18 within post bore 32 as illustrated in FIG. 9. Pushing the tool upward seats lower O-ring 52 into its final installed position. With this step, the rebuilding process for tank fitting 54 is complete. The associated fuel line (not shown) may be reconnected to the fitting and the vehicle may be operated.

While the above described method utilizes two posts 28 and 30 of different lengths, the removal of the upper O-ring 58 may be performed with the same post 28 as the removal of the lower O-ring 52. The different lengths of the hooks 20 and 22 account for the different axial locations of O-rings 52 and 58 inside fitting 54, provided that the hook and 22 is sufficiently stiff to withstand the rotational force where it extends axially beyond post 28. Therefore, mandrel element 11B may not be needed.

While the above description constitutes the preferred embodiment of the present invention, it will be appreciated that the invention is susceptible to modification, variation and change without departing from the proper scope and fair meaning of the accompanying claims.

The invention claimed is:

1. A method of rebuilding a motorcycle fuel tank quick connect fitting having internally disposed an upper O-ring, a lower O-ring, a valve stem, and a spring, comprising:

providing a tool having a mandrel having at least one post extending from a body portion, the at least one post forming an internal bore and an axial groove, a generally cylindrical bushing having an internal bore enabling the bushing to be disposed on the at least one post, the bushing forming an axial slit, a mandrel sleeve element having a bore enabling the sleeve element to be disposed on the at least one post, a stem element, and a first O-ring capture hook which may be installed onto the mandrel within the mandrel groove and locked into place by installing the bushing on the at least one post, the mandrel, bushing and the first O-ring hook adapted to be inserted into the fuel tank fitting for removing the lower O-ring, positioning the bushing over one post of the at least one post and aligning the bushing slit and the post groove, inserting the first hook into the post groove through the bushing slit, rotating the bushing relative to the at least one post to lock the first hook in position, inserting the first hook with the tool into the fitting and rotating the tool, causing the first hook to capture the lower O-ring, removing the tool from the fitting, thereby removing the lower O-ring, removing the first hook, positioning the bushing over the at least one post or another post of the at least one post and aligning the bushing slit and the post groove, providing and inserting a second hook into the post groove, rotating the bushing relative to the at least one post to lock the second hook in position, inserting the tool into the fitting and rotating the tool causing the second hook to capture the upper O-ring, and removing the upper O-ring, the valve stem, and the spring from a valve.

2. The method according to claim 1, further comprising the steps of positioning the sleeve element onto the mandrel post, positioning the valve stem, the spring, and the upper O-ring onto the sleeve element, and inserting the tool into the fitting, thereby installing the spring, the valve stem, and the upper O-ring.

3. The method according to claim 2, further comprising the steps of inserting the stem element into the fitting, placing the lower O-ring around the stem element, pushing the tool into the fitting, thereby positioning the lower O-ring, and removing the tool from the fitting.

* * * * *